US008758113B2

(12) United States Patent
Plowman

(10) Patent No.: US 8,758,113 B2
(45) Date of Patent: Jun. 24, 2014

(54) METHOD OF GAMING, A GAMING SYSTEM AND A GAME CONTROLLER

(75) Inventor: Gregory Leigh Plowman, Alexandria (AU)

(73) Assignee: Aristocrat Technologies Australia Pty Limited, North Ryde (AU)

( * ) Notice: Subject to any disclaimer, the term of this patent is extended or adjusted under 35 U.S.C. 154(b) by 524 days.

(21) Appl. No.: 12/404,075

(22) Filed: Mar. 13, 2009

(65) Prior Publication Data

US 2009/0233694 A1 Sep. 17, 2009

(30) Foreign Application Priority Data

Mar. 13, 2008 (AU) ..... 2008901218

(51) Int. Cl.
*A63F 9/24* (2006.01)

(52) U.S. Cl.
USPC ..... 463/20; 463/22

(58) Field of Classification Search
CPC . G07F 17/32; G07F 17/3209; G07F 17/3211; G07F 17/3213
USPC ..... 463/20, 22, 14
See application file for complete search history.

(56) References Cited

U.S. PATENT DOCUMENTS

| | | | | |
|---|---|---|---|---|
| 2002/0132660 | A1* | 9/2002 | Taylor | 463/16 |
| 2003/0003989 | A1* | 1/2003 | Johnson | 463/25 |
| 2003/0022719 | A1 | 1/2003 | Donald et al. | |
| 2003/0230848 | A1 | 12/2003 | Mellerowicz | |
| 2004/0043811 | A1* | 3/2004 | Seelig et al. | 463/16 |
| 2005/0054422 | A1 | 3/2005 | Rothkranz et al. | |
| 2006/0063584 | A1 | 3/2006 | Brill et al. | |
| 2006/0073867 | A1 | 4/2006 | Rothkranz | |
| 2006/0073868 | A1 | 4/2006 | Nordman | |
| 2007/0010326 | A1 | 1/2007 | Seelig et al. | |
| 2007/0021201 | A1 | 1/2007 | Matsumoto | |
| 2007/0072670 | A1 | 3/2007 | Seelig et al. | |
| 2007/0087808 | A1* | 4/2007 | Luciano et al. | 463/16 |
| 2007/0287530 | A1 | 12/2007 | Seelig et al. | |
| 2007/0290436 | A1 | 12/2007 | Seelig et al. | |
| 2007/0293301 | A1 | 12/2007 | Seelig et al. | |

FOREIGN PATENT DOCUMENTS

| | | |
|---|---|---|
| CA | 2000845 | 4/1990 |
| CA | 2519386 | 12/2003 |
| CA | 2504324 | 10/2006 |
| DE | 102004004035 | 8/2005 |
| GB | 1274249 | 5/1972 |
| GB | 2403914 | 1/2005 |
| WO | WO2004020058 | 3/2004 |
| WO | WO2006039220 | 4/2006 |
| WO | WO2007033310 | 3/2007 |
| WO | WO2007049268 | 5/2007 |

* cited by examiner

*Primary Examiner* — Khiem D Nguyen
(74) *Attorney, Agent, or Firm* — Hanley, Flight and Zimmerman, LLC

(57) ABSTRACT

A method of gaming including: displaying to a player a potential award and an indicator having an indicator state when active during play of a game; changing the indicator state in response to play of the game; changing the potential award in response to play of the game; and awarding the potential award which is displayed when the indicator state is an award state.

39 Claims, 9 Drawing Sheets

METHOD OF GAMING, A GAMING SYSTEM AND A GAME CONTROLLER

CROSS-REFERENCE TO RELATED APPLICATIONS

The present application claims the benefit of priority to Australian Provisional Patent Application No. 2008901218, filed on Mar. 13, 2008, entitled "A METHOD OF GAMING, A GAMING SYSTEM AND A GAME CONTROLLER", which is herein incorporated by reference in its entirety.

FIELD

The present invention relates to a method of gaming, a gaming system and a game controller.

BACKGROUND TO THE INVENTION

Gaming systems are known comprising a game controller arranged to randomly display several symbols from a predetermined set of symbols and to determine a game outcome such as a game win based on the displayed symbols. Such gaming systems may commonly be implemented as a stepper machine provided with reels with each reel carrying several symbols of the set, or a video machine with selected symbols are displayed in virtual reels on a video display.

While such systems provide users with enjoyment, there is a need for alternative or enhanced gaming systems and methods to add to player excitement.

SUMMARY OF THE INVENTION

According to a first aspect of the invention there is provided a method of gaming including:

- displaying to a player a potential award and an indicator having an indicator state when active during play of a game;
- changing the indicator state in response to play of the game;
- changing the potential award in response to play of the game; and
- awarding the potential award which is displayed when the indicator state is an award state.

In an embodiment, the indicator is an image of a clock and the changing indicator state is a changing time displayed on the clock.

In an embodiment, the method further includes displaying the potential award as one of a plurality of displayed potential awards which move into and out of a current potential award display position.

In an embodiment, the method further includes randomly selecting each of the plurality of potential awards prior to display so as to provide a random sequence of potential awards.

In an embodiment, play of the game includes generating game round outcomes, and when the indicator is active, the method includes altering the potential award for each game round.

In an embodiment, the method further includes randomly determining whether to change the indicator state.

In an embodiment, the indicator is activate during a main game including main game rounds of;

- randomly selecting main game symbols for display to the player in a set of display positions corresponding to a plurality of spinning reels set side by side; and

- determining a main game round outcome based on the selected main game symbols.

In an embodiment, the method of gaming is played simultaneously with the main game rounds.

In an embodiment, at least one of the main game symbols is a special main game symbol which changes the indicator state when selected.

In an embodiment, selection of the special main game symbol sets the indicator state to the award state.

In an embodiment, selection of the special main game symbol increments the indicator state.

In an embodiment, the increment is randomly selected.

According to a second aspect of the invention there is provided a gaming system for implementing an indicator game round including:

- a display;
- an indicator controller adapted to control a changing indicator state;
- a potential award generator adapted to generate a changing potential award;
- a display controller adapted to control the display to display the indicator state and the potential award when the indicator is active; and
- an award controller adapted to award to the player the potential award which is displayed when the indicator state is an award state.

In an embodiment, the indicator is an image of a clock and the changing indicator state is a changing time displayed on the clock.

In an embodiment, the display controller is adapted to display the potential award as one of a plurality of potential awards which move into and out of a current potential award display position.

In an embodiment, the gaming system includes a random number generator.

In an embodiment, the potential award generator is arranged to employ the random number generator to randomly select each of the plurality of potential awards prior to display so as to provide a random sequence of potential awards.

In an embodiment, play of the game includes generating game round outcomes, and when the indicator game round is active, the potential award generator is arranged to alter the potential award for each game round.

In an embodiment, the indicator controller is arranged to randomly determining whether to change the indicator state.

In an embodiment, the gaming system further includes a main game controller for implementing a main game including main game rounds during which the indicator game round is activate, the main game controller having;

- a main game round symbol selector for selecting main game symbols for display to the player in a set of display positions corresponding to a plurality of spinning reels set side by side; and
- a main game round outcome determiner for determining a main game round outcome based on the selected main game symbols.

In an embodiment, the main game controller is adapted to implement main game rounds simultaneously with the indicator game rounds.

In an embodiment, at least one of the main game symbols is a special main game symbol which causes the indicator controller to change the indicator state when selected.

In an embodiment, the indicator controller is arranged to randomly select the increment.

In an embodiment, the indicator controller is adapted to set the indicator state to the award state when the main game round symbol selector selects the special main game symbol.

In an embodiment, at least one of the indicator controller, the potential award generator, the display controller and the award controller is implemented, at least in part, by a processor executing code stored in a memory.

In an embodiment, the display forms part of a player interface further including a game play mechanism operable by the player to place a bet.

According to a third aspect of the invention there is provided a game controller including:

an indicator controller adapted to control a changing indicator state;

a potential award generator adapted to generate a changing potential award;

a display controller adapted to control a display to display the indicator state and the potential award when the indicator is active; and an award controller adapted to award to the player the potential award which is displayed when the indicator state is an award state.

In an embodiment, the indicator is an image of a clock and the changing indicator state is a changing time displayed on the clock.

In an embodiment, the display controller is adapted to display the potential award as one of a plurality of potential awards which move into and out of a current potential award display position.

In an embodiment, the game controller includes a random number generator.

In an embodiment, the potential award generator is arranged to employ the random number generator to randomly select each of the plurality of potential awards prior to display so as to provide a random sequence of potential awards.

In an embodiment, play of the game includes generating game round outcomes, and when the indicator game round is active, the potential award generator is arranged to alter the potential award for each game round.

In an embodiment, the indicator controller is arranged to randomly determining whether to change the indicator state.

In an embodiment, the game controller further includes a main game controller for implementing a main game including main game rounds during which the indicator game round is activate, the main game controller having;

a main game round symbol selector for selecting main game symbols for display to the player in a set of display positions corresponding to a plurality of spinning reels set side by side; and a main game round outcome determiner for determining a main game round outcome based on the selected main game symbols.

In an embodiment, the main game controller is adapted to implement main game rounds simultaneously with the indicator game rounds.

In an embodiment, at least one of the main game symbols is a special main game symbol which causes the indicator controller to change the indicator state when selected.

In an embodiment, the indicator controller is arranged to randomly select the increment.

In an embodiment, the indicator controller is adapted to set the indicator state to the award state when the main game round symbol selector selects the special main game symbol.

In an embodiment, the game controller is implemented, at least in part, by a processor executing code stored in a memory.

According to a fourth aspect of the invention there is provided computer program code when executed by a computer causes the computer to implement any of the embodiments of the method of gaming of the first aspect of the invention.

According to a fifth aspect of the invention there is provided a computer readable medium including the program code of the fourth aspect of the invention.

According to a sixth aspect of the invention there is provided a data signal including the computer program code of the fourth aspect of the invention.

According to a seventh aspect of the invention extends to transmitting the computer program code of the fourth aspect of the invention.

BRIEF DESCRIPTION OF DRAWINGS

Embodiments of the invention are described in relation to the following drawings in which.

Figure 1:
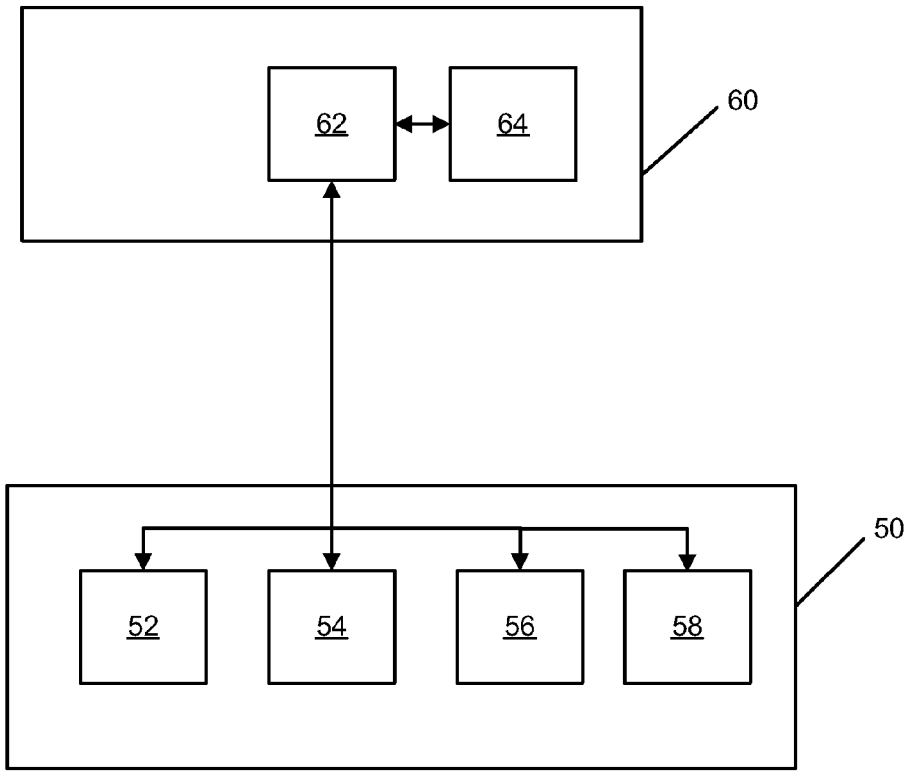
FIG. 1 is a block diagram of the core components of a gaming system.

Further aspects of the present invention will be apparent from the following description, given by way of example and with reference to the accompanying drawings. Also, various embodiments of the aspects described in the preceding paragraphs will be apparent from the appended claims, the following description and/or the accompanying drawings. It should be understood, however, that the present invention is not limited to the arrangements and instrumentality shown in the attached drawings.

DETAILED DESCRIPTION

Referring to the drawings, there is shown a gaming system having a game controller arranged to implement a game, during at least part of which there is a displaying to a player of a potential award and an indicator. The indicator's state and the potential award are changed in response to play of the game. The potential award which is displayed when the indicator state is an award state is awarded to the player.

The gaming system may take a number of different forms. In a first form, a stand alone gaming machine is provided wherein all or most components implementing the game are present in a player operable gaming machine.

In a second form, a distributed architecture is provided wherein some of the components implementing the game are present in a player operable gaming machine and some of the components implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, the gaming system includes several core components. At the broadest level, the core components are a player interface 50 and a game controller 60 as illustrated in FIG. 1. The player interface is arranged to enable manual interaction between a player and the gaming system and for this purpose includes the input/output components for the player to enter instructions and play the game.

Components of the player interface may vary from embodiment to embodiment but will typically include a credit mechanism 52 to enable a player to input credits and receive payouts, one or more displays 54, a game play mechanism 56 including one or more input devices that enable a player to input game play instructions (e.g. to place bets), and one or more speakers 58.

The game controller 60 is in data communication with the player interface and typically includes a processor 62 that processes the game play instructions in accordance with game play rules and outputs game play outcomes to the display. Typically, the game play instructions are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server.

Figure 2:
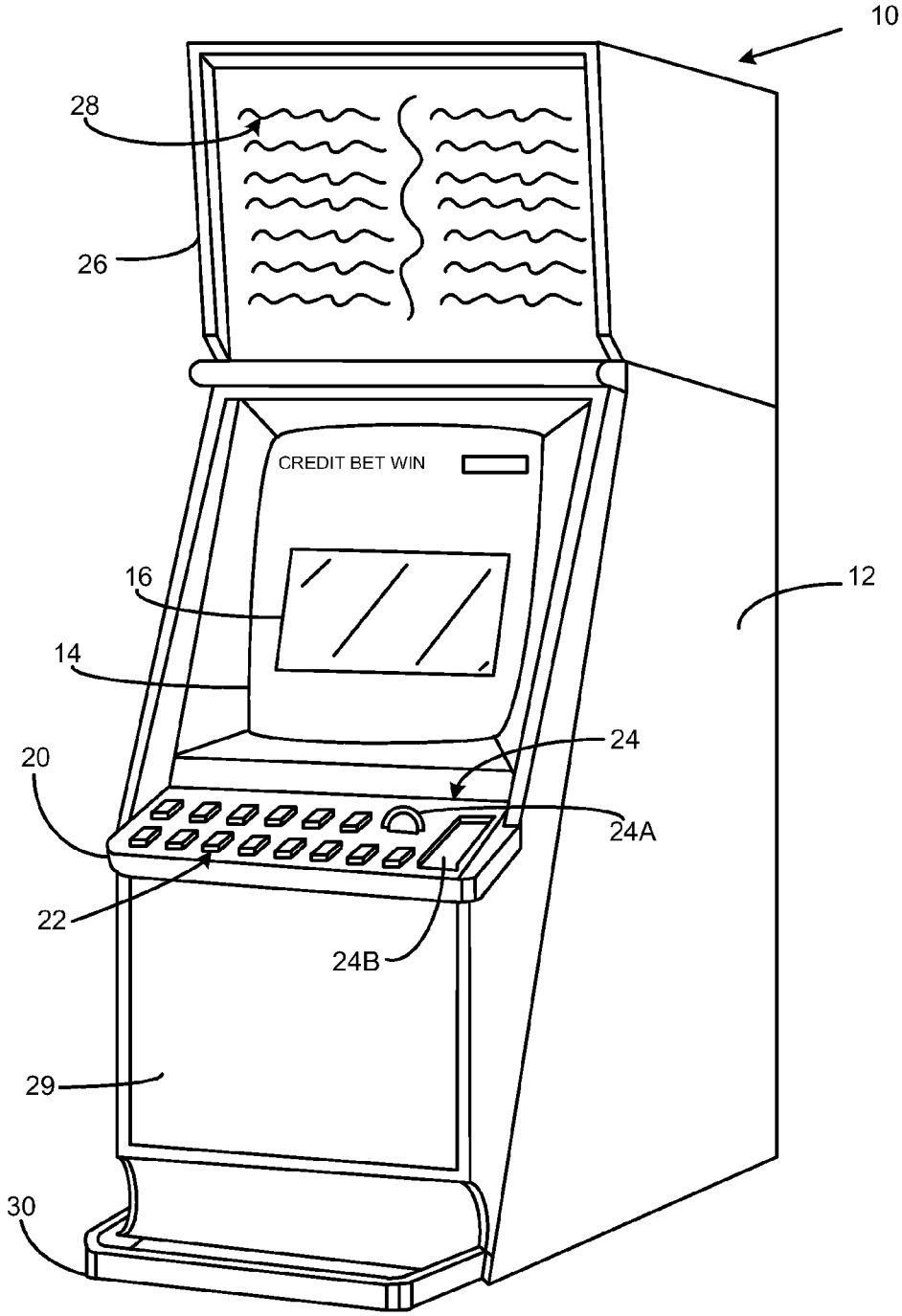
FIG. 2 is a perspective view of a stand alone gaming machine.

A gaming system in the form of a stand alone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. A player marketing module (not shown) having a reading device may also be provided for the purpose of reading a player tracking device, for example as part of a loyalty program. The player tracking device may be in the form of a card, flash drive or any other portable storage medium capable of being read by the reading device.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
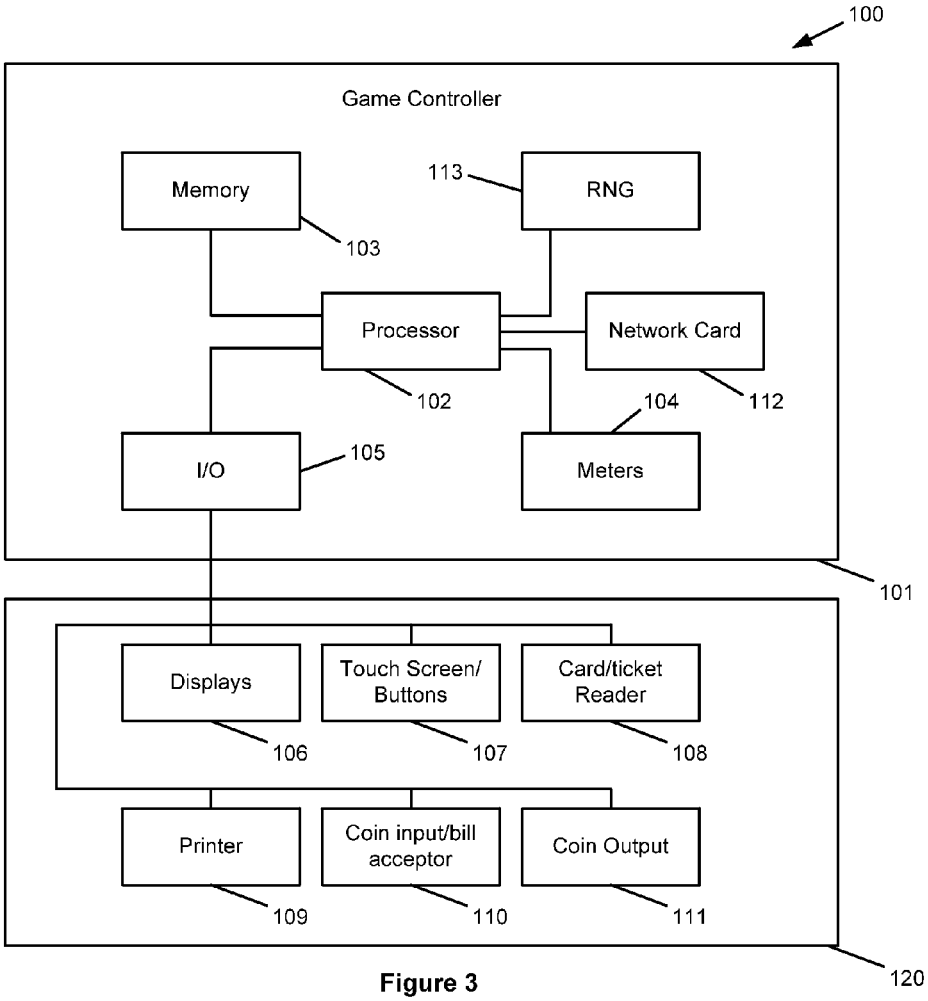
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 include one or more displays 106, a touch screen and/or buttons 107, a card and/or ticket reader 108, a printer 109, a bill acceptor and/or coin input mechanism 110 and a coin output mechanism 111. Additional hardware may be included as part of the gaming machine 100, or hardware may be omitted based on the specific implementation. For example, while buttons or touch screens are typically used in gaming machines to allow a player to place a wager and initiate a play of a game any input device that enables the player to input game play instructions may be used. For example, in some gaming machines a mechanical handle is uses to initiate a play of the game.

In addition, the gaming machine 100 may include a communications interface, for example a network card 112. The network card may, for example, send status information, accounting information or other information to a central controller, server or database and receive data or commands from the central controller, server or database.

Figure 4:
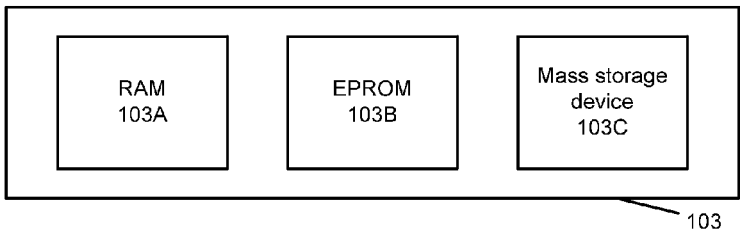
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106, 107, 108, 109, 110, 111 to be provided remotely from the game controller 101.

Figure 5:
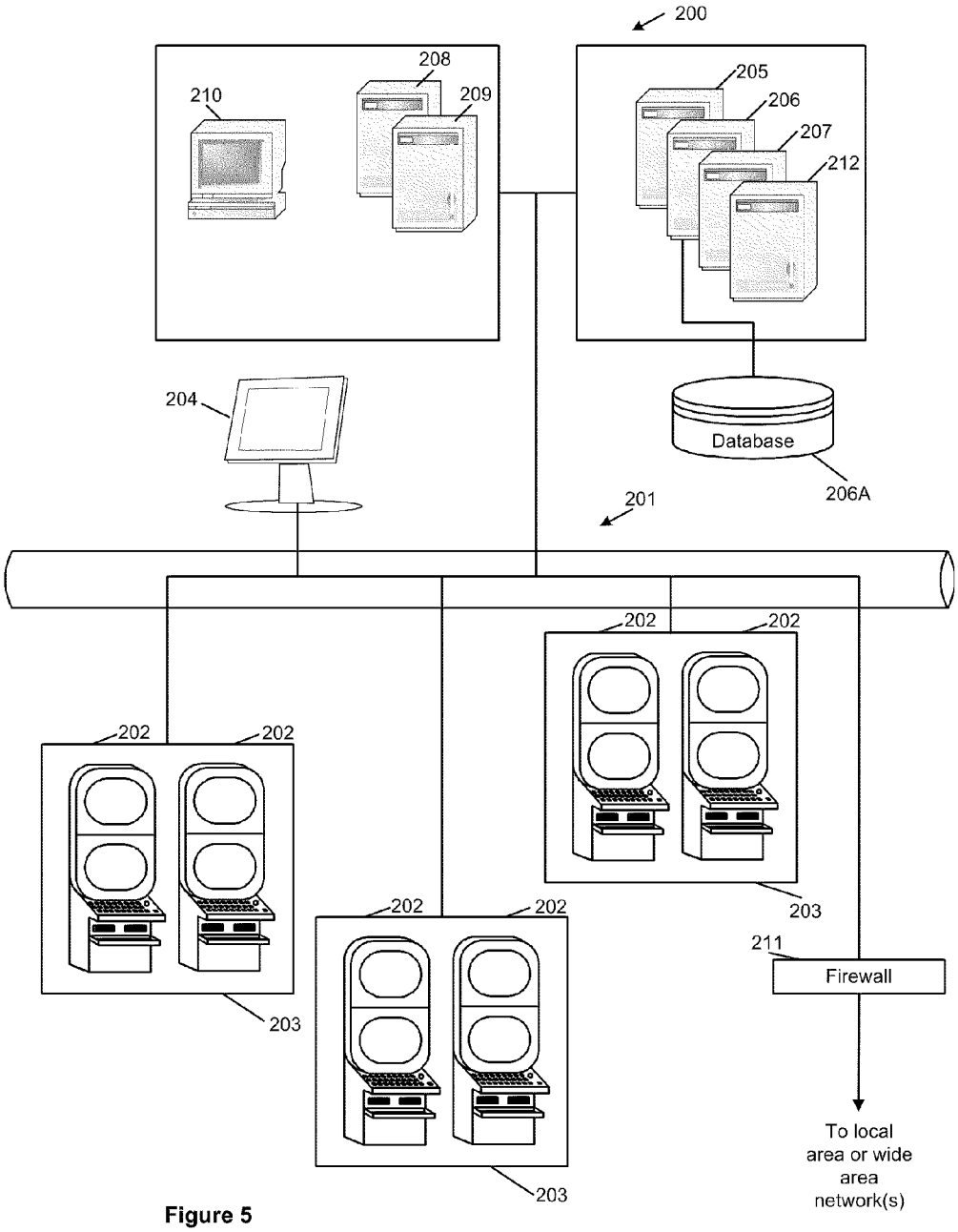
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the rules and/or guidelines for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of games servers could be provided to run different games or a single game server may run a plurality of different games based on the terminals.

Embodiments of the invention relate to gaming systems for implementing games that involve a display of spinning reels as part of the display of the outcome of the game.

The game controllers of such gaming systems have symbol selection function which includes a stop determining function that determines the stop position for each reel. For example, if there are five reels, each having twenty symbols, the stop determining function might determine that the stop positions are positions: 3, 13, 7, 9 and 17. The spinning of the reels is then controlled so that each symbol comes to a stop in the same row, typically a predetermined row in a "window" corresponding to a "single win line" game. When a reels stops, the symbols will be in one of a plurality of possible symbol positions for that reel relative to the stop position.

Exemplary embodiments of the present invention relate to gaming systems that allow a player to select, in non-feature games, how many win lines of a plurality of win lines they will play in each game—i.e. a minimum of one win line up to the maximum number of win lines allowed by the game. Each win line is formed by a set of symbol positions consisting of one symbol position from each reel. That is, a predetermined symbol position of each reel is assigned to a win line. The symbol positions that constitute each of the win lines are usually advertised to the player by markings on the display or diagrams showing the symbol positions that correspond to each win line. Persons skilled in the art will appreciate that there are other techniques used in the art to enable a player to place a wager.

Figure 6:
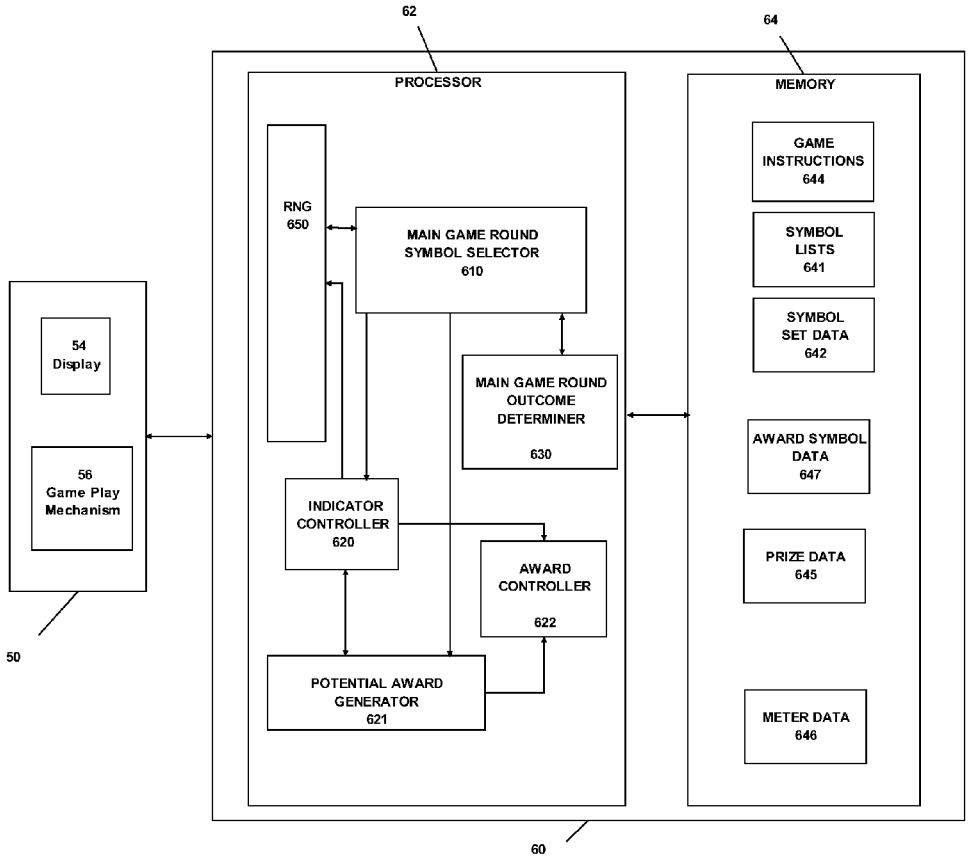
FIG. 6 is a further block diagram of the gaming system.

The game controller of one embodiment is shown in more detail in FIG. 6. The game controller 60 incorporates a processor 62 which implements a main game round symbol selector 610, main game round outcome determiner 630, random number generator 650, indicator controller 620, award controller 622 and potential award sequence generator 621. Connected to the processor 62 is a memory 64 incorporating game instructions 644, symbol lists 641, symbol set data 642, award symbol data 64, prize data 645 and meter data 646. Persons skilled in the art will appreciate that one or more of these components could be provided in other ways, for example by a dedicated circuit.

In an example of a game to which the invention is applied, in a main game round main game round symbol selector 610 selects symbols for display in the set of display positions, from symbol lists 641, and updates symbol set data 642 with the selected set of symbols and displays the set of symbols in their assigned display positions on the display 54. Main game round outcome determiner 630 determines a game round outcome based on the win lines defining one symbol on each reel, using prize data 645 and then updates meter data 646. In the embodiment, an indicator feature is activated in response to a trigger event but in other embodiments, the indicator may always be active. When active indicator controller 620 controls the state of the indicator to be displayed on display 54 (which may be more than one display, for example the indicator may be displayed on a top box). Potential award generator 621 randomly generates a sequence of potential awards to be displayed on display 54 by selecting potential awards from a set of potential awards stored in memory 64 using random number generator 650 such that a plurality of awards are displayed at any time, one of which is a current award. The other potential awards that are displayed may be past or future awards or a combination of past and future awards. In this embodiment, the potential award sequence is selected dynamically just prior to the award being displayed so that the awards do not become predictable to the player.

The potential awards and indicator state are influenced by outcomes in the main game rounds by communication with main game symbol selector 610, that is they change in response to game play. In this embodiment, the potential award sequence is advance by one for each play of the game. In this embodiment, the indicator is advanced randomly. Award controller 622 controls the granting of the potential award which is displayed when indicator controller 620 sets the indicator state to an award indicator state.

Figure 7:
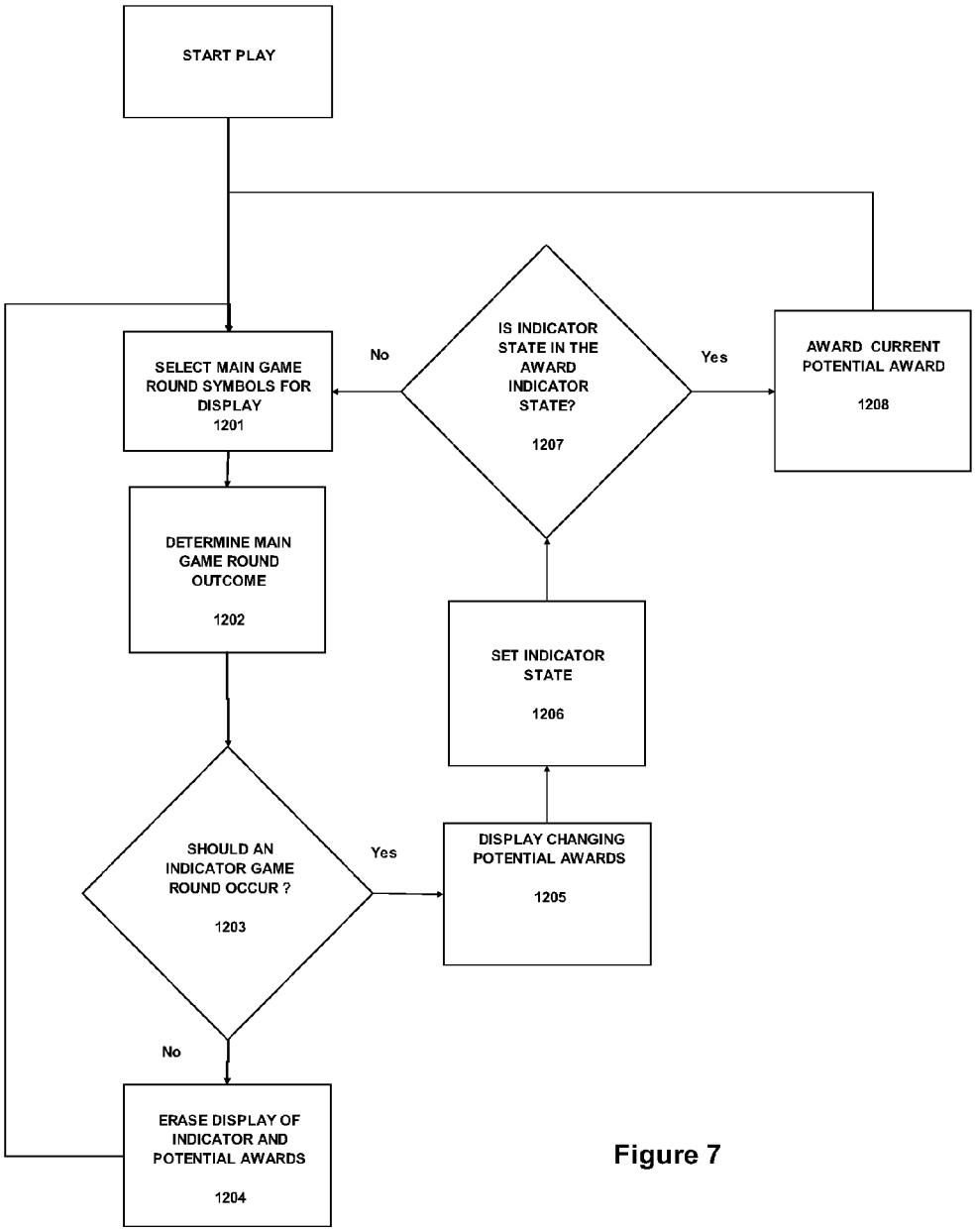
FIG. 7 shows a flow diagram for the method of an embodiment of the invention.

Now referring to FIG. 7, a flow diagram for an embodiment of the invention is shown. This is an example where an embodiment of the invention is applied to a main game, typically involving the selection of symbols on representations of spinning reels.

In step 1201, in a main game round the main game symbols are selected and in step 1202 a main game round outcome is determined based on the selected main game symbols. In step 1203 it is determined (depending on the embodiment), on the basis of a feature of the main game round, a random event, player selection or other reason, whether an "indicator game round" should occur". If not, in step 1204 any previous display from an indicator game round is erased and the next main game round is conducted normally, control returning to step 1201. If so, additional features are introduced in parallel with the main game. In particular, in step 1205 a changing potential award is displayed, which may be in the form of a moving strip. The set of potential awards is dynamically created by randomly selecting the awards. The awards can be adjusted to meet market or regulatory requirements. Hence if a market has a limit to the value of top prizes and a player is placing large bets, then rather than increasing the value of prizes, the number of large prizes can increment. What is displayed to the player is at least the current potential award, and may include several other future or past potential awards in a strip. In step 1205, the indicator state is set. This may be, for example, an increment of the indicator, which may be a minute hand, to a new slightly later time, or a jump of the indicator to a completely new time. In some cases, the indicator may not change. For example, the indicator may be associated with one or more game evens which must occur for the indicator to change, such as the appearance of a symbol in the main game. In step 1207, it is determined whether the indicator state is the award indicator state. This may for example be the minute hand pointing to or passing a specific time such as the "hour" in the '12' clock position. If not, control returns to the next main game round, step 1201. If so, the current potential award is made to the player. This may be displayed by an image of a cuckoo appearing and pointing with its beak to the current potential award on the display 54. The current potential award may be cash, jackpot or non-cash prizes, free games, feature games or other awards known in the art.

In embodiments, where an increment is applied, the increment can be determined in a number of ways, for example it can be fixed, randomly calculated when a designated symbol appears, each occurrence of a designated symbol may have an associated increment (e.g. one symbol might move the minute hand by 10 minutes when it appears whereas another moves the minute hand by 25 minutes).

In the case, where symbols jump to specific times, specific times may be associated with specific designated symbols on the reels.

Other indicators may be employed such as a gauge or other graphic representation of progress.

EXAMPLE 1

Figure 8A:
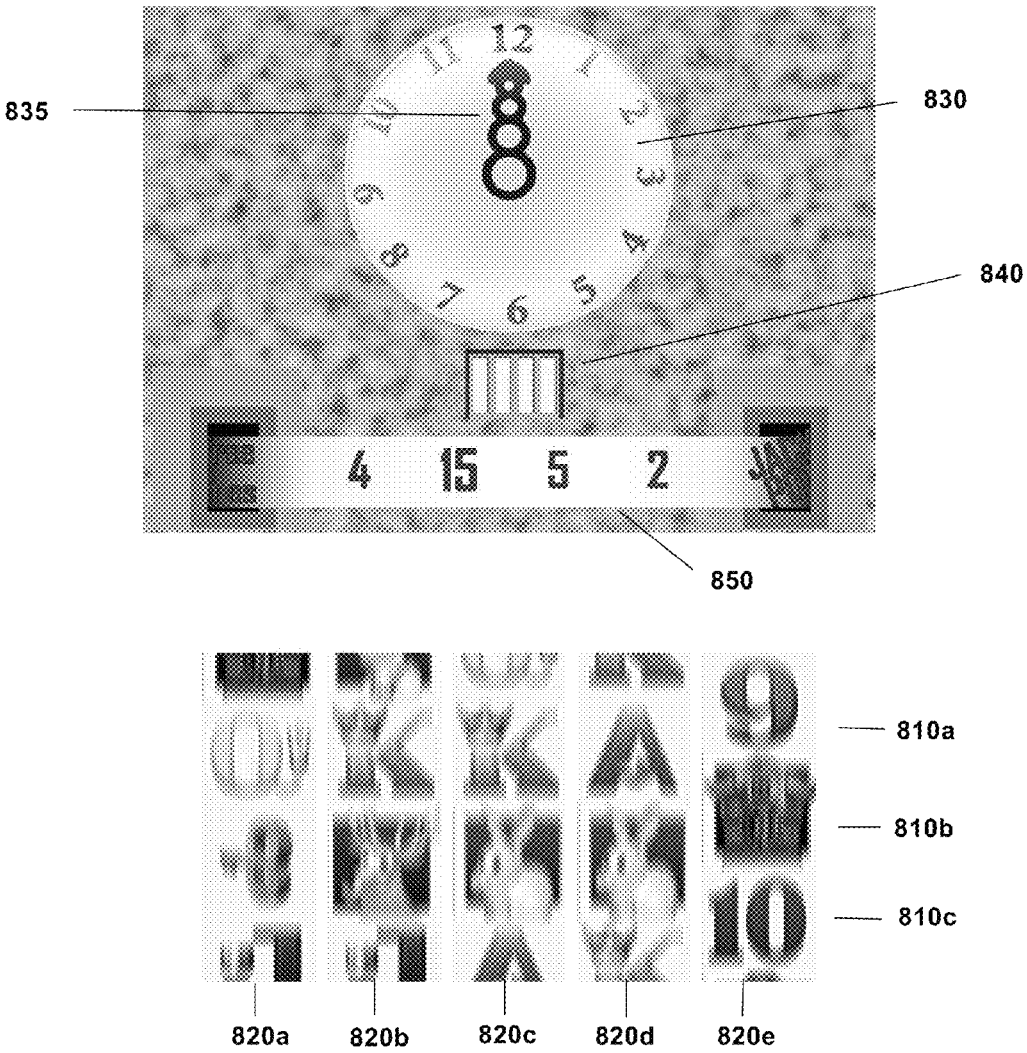
FIGS. 8A, 8B and 8C show the displays of Example 1.
Figure 8B:
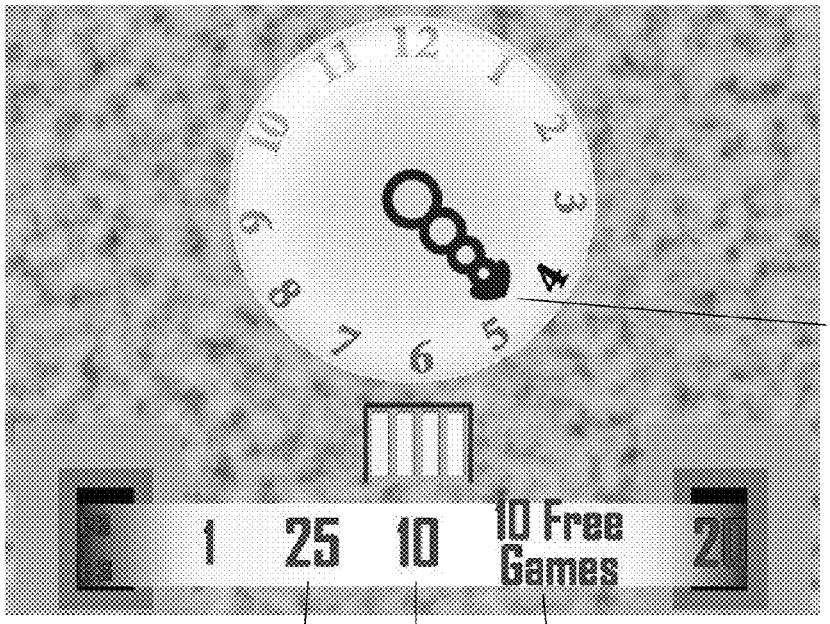
Figure 8B:
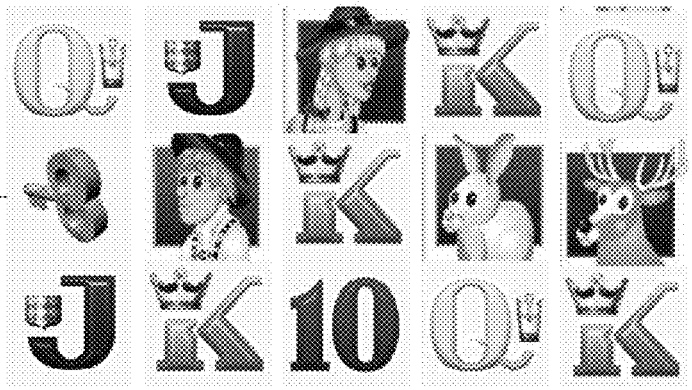
Figure 8C:
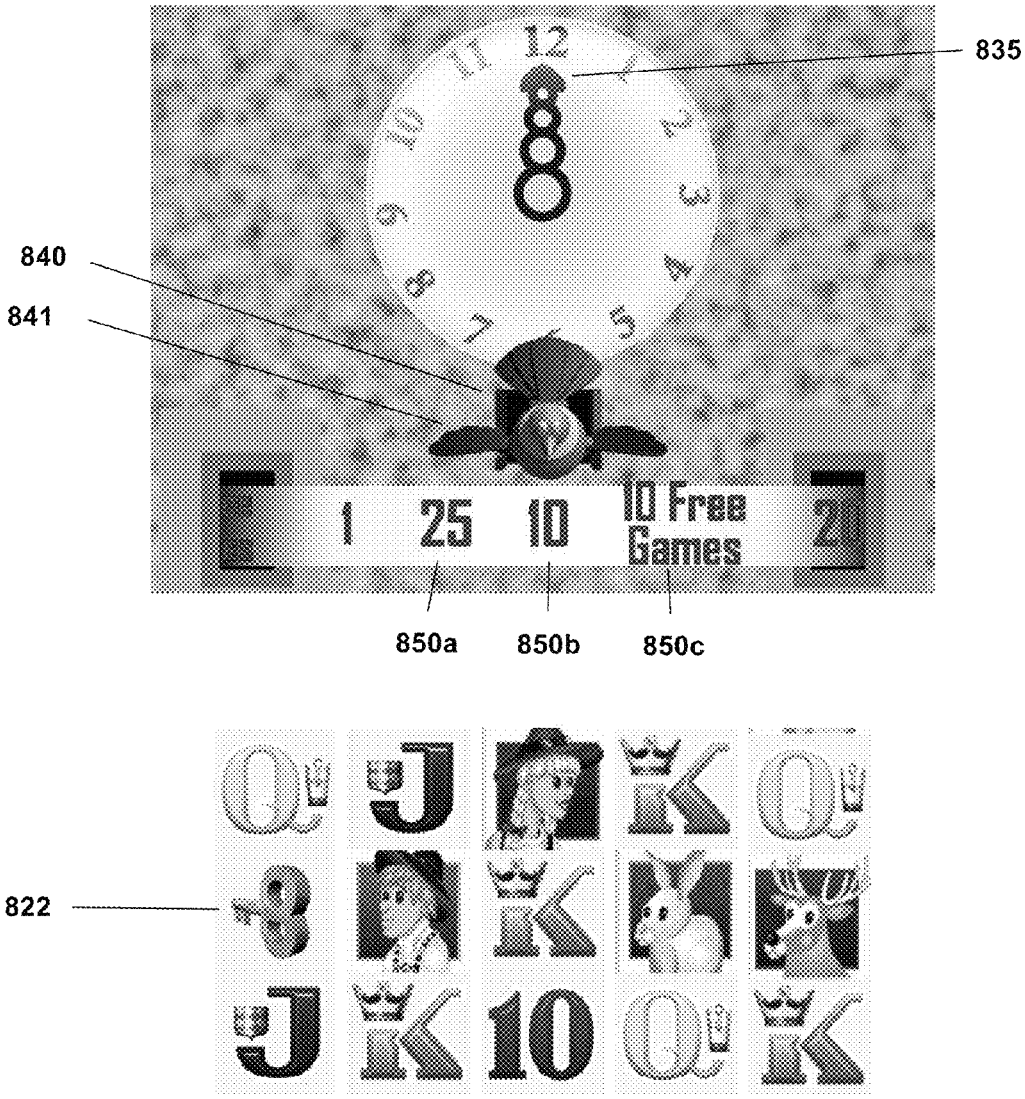

Now referring to FIGS. 8A, 8B and 8C, an example of one embodiment of the method of the invention is shown.

FIG. 8A shows a display according to an embodiment of the invention where an indicator game round has been activate during a main game round. At the lower half of the display, five spinning reels 820*a* to 820*e* are shown, which when stopped will show visible symbols on rows 810*a* to 810*c* as shown as is known in the art. Typically, one or more of the rows 810*a* to 810*c* is used as a "win line" to determine a main game outcome on the basis of the symbols on that row. On the upper part of the display is shown aspects of an embodiment of the invention. An indicator includes clock face 830, minute hand 835 and cuckoo window 840. Initially the indicator state is at midnight and starts moving as the reels spin. Potential awards are displayed on a strip 850, and in this figure the current potential award, which will be the one immediately below the cuckoo window when the reels stop, is in transition.

FIG. 8A shows the display one the reels have stopped. The minute hand has stopped at in between 4 and 5 on the clock and the strip of potential awards has also stopped. The potential award 850*b* located in the current potential award position below the cuckoo window is a points or cash prize of 10 units, and potential awards 850*a* and 850*c* which appear to have just missed being selected are "25" points and "10 Free Games" as shown. On the main game section a special main game symbol 822 in the form of a key has appeared. In the absence of the symbol, the indicator would remain in the non-award position shown between 4 and 5, and the next main game round with its indicator embellishment would begin.

However the presence of the special symbol changes the situation, as shown in FIG. 8C, where the key 822 is shown turning and forcing the minute hand 822 to the award indicator position at the midnight or "12" position. Cuckoo 841 then emerges from cuckoo window 840 to signify the award of the current potential award 850*b*, and 10 points are added to the player's meter. In other embodiments the special symbol may simply increment the indicator by an amount, which may or may not place the indicator state in the award indicator state. In still other embodiments the appearance of more than one special main game symbol can have different effects, such as two different increments of the indicator state.

In reality the probability of the potential awards such as 850*a* and 850*c* or other awards on the strip being awarded is not necessarily equal to the potential award which is actually selected, as the outcome may be predetermined before the spin starts, and adjusted according to game, market or regulatory requirements.

Return to non-indicator game rounds may be caused by the elapse of a fixed number of indicator game rounds, a random event or other trigger.

Persons skilled in the art will recognize that the invention resides in the exciting nature of the changing indicator state and potential award, and any other visual representation of such changing states, and any underlying probabilities on which the actual awards depends, are within the scope of the invention. Also, the main game can be absent or replaced by a card game or keno game. Persons skilled in the art will appreciate that the amount of the award which is available can be controlled based on factors such as the amount bet or the number of lines played.

Persons skilled in the art will appreciate that the method of the embodiment could be embodied in program code. The program code could be supplied in a number of ways, for example on a computer readable medium, such as a disc or a memory (for example, that could replace part of memory 103) or as a data signal (for example, by downloading it from a server).

Persons skilled in the art will also appreciate that many variations may be made to the invention without departing from the scope of the invention. In particular, features described herein can be sued to form further embodiments.

In the claims which follow and in the preceding description of certain embodiments of the invention, except where the context indicates otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art publication is referred to herein, such reference does not constitute an admission that the publication forms a part of the common general knowledge in the art, in Australia or any other country.

It will be appreciated by persons skilled in the art that numerous variations and/or modifications may be made to the invention as shown in the specific embodiments and/or aspects without departing from the spirit or scope of the invention as broadly described. The present embodiments and aspects are, therefore, to be considered in all respects as illustrative and not restrictive. Several embodiments are described above with reference to the drawings. These drawings illustrate certain details of specific embodiments that implement the systems and methods and programs of the present invention. However, describing the invention with drawings should not be construed as imposing on the invention any limitations associated with features shown in the drawings. It will be understood that the invention disclosed and defined in this specification extends to all alternative combinations of two or more of the individual features mentioned or evident from the text or drawings. All of these different combinations constitute various alternative aspects of the invention.

The present invention contemplates methods, systems and program products on any electronic device and/or machine-readable media suitable for accomplishing its operations. Certain embodiments of the present invention may be implemented using an existing computer processor and/or by a special purpose computer processor incorporated for this or another purpose or by a hardwired system, for example.

Embodiments within the scope of the present invention include program products comprising machine-readable media for carrying or having machine-executable instructions or data structures stored thereon. Such machine-readable media can be any available media that can be accessed by a general purpose or special purpose computer or other machine with a processor. By way of example, such machine-readable media may comprise RAM, ROM, PROM, EPROM, EEPROM, Flash, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such a connection is properly termed a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions.

The invention claimed is:

1. A method of gaming comprising:

displaying to a player, using a processor, a potential award and an indicator having a plurality of indicator states when active during play of a game, the potential award being displayed separately from the indicator;

changing, using a processor, the indicator state among the plurality of indicator states in response to play of the game, wherein only one of the indicator states is an award state that is indicative of an award winning outcome, and wherein the other indicator states are indicative of non-winning outcomes;

changing, using a processor, the potential award in response to play of the game, wherein the potential award is selected from a plurality of displayed potential awards which move into and out of a current potential award display position; and awarding the potential award which is displayed only when the indicator state is in the award state.

2. A method of gaming as claimed in claim 1 wherein the indicator is an image of a clock and the changing indicator state is a changing time displayed on the clock.

3. A method of gaming as claimed in claim 1, comprising randomly selecting each of the plurality of potential awards prior to display so as to provide a random sequence of potential awards.

4. A method as claimed in claim 1, wherein play of the game comprises generating game round outcomes, and when the indicator is active, the method comprises altering the potential award for each game round.

5. A method as claimed in claim 1 comprising randomly determining whether to change the indicator state.

6. A method of gaming as claimed in claim 1, wherein the indicator is to be activated during a main game comprising main game rounds of;

randomly selecting main game symbols for display to the player in a set of display positions corresponding to a plurality of spinning reels set side by side; and determining a main game round outcome based on the selected main game symbols.

7. A method of gaming as claimed in claim 6, wherein the game is to be played simultaneously with the main game rounds.

8. A method of gaming as claimed in claim 7 wherein at least one of the main game symbols is a special main game symbol which changes the indicator state when selected.

9. A method of gaming as claimed in claim 8 wherein selection of the special main game symbol sets the indicator state to the award state.

10. A method of gaming as claimed in claim 8 wherein selection of the special main game symbol increments the indicator and associated indicator state.

11. A method as claimed in claim 10, wherein the increment is randomly selected.

12. A gaming system for implementing an indicator game round comprising:

a display;

an indicator controller adapted to control a changing indicator state among a plurality of indicator states in response to play of a game, wherein only one of the indicator states is an award state that is indicative of an award winning outcome, and wherein the other indicator states are indicative of non-winning outcomes;

a potential award generator adapted to generate a changing potential award;

a display controller adapted to control the display to display the indicator state and the potential award when the indicator is active, the potential award being displayed separately from the indicator; and an award controller adapted to award to the player the potential award which is displayed only when the indicator state is in the award state, wherein the potential award is selected from a plurality of displayed potential awards which move into and out of a current potential award display position.

13. A gaming system as claimed in claim 12 wherein the indicator is an image of a clock and the changing indicator state is a changing time displayed on the clock.

14. A gaming system as claimed in claim 12 wherein the display controller is adapted to display the potential award as one of a plurality of potential awards which move into and out of a current potential award display position.

15. A gaming system as claimed in claim 12 comprising a random number generator.

16. A gaming system as claimed in claim 15 wherein the display controller is adapted to display the potential award as one of a plurality of potential awards which move into and out of a current potential award display position, and wherein the potential award generator is arranged to employ the random number generator to randomly select each of the plurality of potential awards prior to display so as to provide a random sequence of potential awards.

17. A gaming system as claimed in claim 12, wherein play of the game comprises generating game round outcomes, and when the indicator game round is active, the potential award generator is arranged to alter the potential award for each game round.

18. A gaming system as claimed in claim 15, wherein the indicator controller is arranged to randomly determining whether to change the indicator state.

19. A gaming system as claimed in claim 12, further comprising a main game controller for implementing a main game comprising main game rounds during which the indicator game round is activate, the main game controller having;

a main game round symbol selector for selecting main game symbols for display to the player in a set of display positions corresponding to a plurality of spinning reels set side by side; and a main game round outcome determiner for determining a main game round outcome based on the selected main game symbols.

20. A gaming system as claimed in claim 19, wherein the main game controller is adapted to implement main game rounds simultaneously with the indicator game rounds.

21. A gaming system as claimed in claim 20 wherein at least one of the main game symbols is a special main game symbol which causes the indicator controller to change the indicator state when selected.

22. A gaming system as claimed in claim 21, wherein the indicator controller is arranged to randomly select an increment by which the indicator and associated indicator state are to change.

23. A gaming system as claimed in claim 20 wherein the indicator controller is adapted to set the indicator state to the award state when the main game round symbol selector selects the special main game symbol.

24. A gaming system as claimed in claim 12 wherein at least one of the indicator controller, the potential award generator, the display controller and the award controller is implemented, at least in part, by a processor executing code stored in a memory.

25. A gaming system as claimed in claim 12 wherein the display forms part of a player interface further comprising a game play mechanism operable by the player to place a bet.

26. A game controller comprising:

an indicator controller adapted to control a changing indicator state among a plurality of indicator states in response to play of a game, wherein only one of the indicator states is an award state that is indicative of an award winning outcome, and wherein the other indicator states are indicative of non-winning outcomes;

a potential award generator adapted to generate a changing potential award;

a display controller adapted to control a display to display the indicator state and the potential award when the indicator is active, the potential award being displayed separately from the indicator; and an award controller adapted to award to the player the potential award which is displayed only when the indicator state is in the award state, wherein the potential award is selected from a plurality of displayed potential awards which move into and out of a current potential award display position.

27. A game controller as claimed in claim 26 wherein the indicator is an image of a clock and the changing indicator state is a changing time displayed on the clock.

28. A game controller as claimed in claim 26 wherein the display controller is adapted to display the potential award as one of a plurality of potential awards which move into and out of a current potential award display position.

29. A game controller as claimed in claim 26 comprising a random number generator.

30. A game controller as claimed in claim 29 wherein the display controller is adapted to display the potential award as one of a plurality of potential awards which move into and out of a current potential award display position, and wherein the potential award generator is arranged to employ the random number generator to randomly select each of the plurality of potential awards prior to display so as to provide a random sequence of potential awards.

31. A game controller as claimed in claim 26, wherein play of the game comprises generating game round outcomes, and when the indicator game round is active, the potential award generator is arranged to alter the potential award for each game round.

32. A game controller as claimed in claim 26, wherein the indicator controller is arranged to randomly determining whether to change the indicator state.

33. A game controller as claimed in claim 26, further comprising a main game controller for implementing a main game comprising main game rounds during which the indicator game round is activate, the main game controller having;

a main game round symbol selector for selecting main game symbols for display to the player in a set of display positions corresponding to a plurality of spinning reels set side by side; and a main game round outcome determiner for determining a main game round outcome based on the selected main game symbols.

34. A game controller as claimed in claim 33, wherein the main game controller is adapted to implement main game rounds simultaneously with the indicator game rounds.

35. A game controller as claimed in claim 34 wherein at least one of the main game symbols is a special main game symbol which causes the indicator controller to change the indicator state when selected.

36. A game controller as claimed in claim 35, wherein the indicator controller is arranged to randomly select an increment by which the indicator and associated indicator state are to change.

37. A game controller as claimed in claim 34 wherein the indicator controller is adapted to set the indicator state to the award state when the main game round symbol selector selects the special main game symbol.

38. A game controller as claimed in claim 26 implemented, at least in part, by a processor executing code stored in a memory.

39. A tangible computer readable storage medium comprising computer program code which when executed by a computer causes the computer to implement a method of gaming comprising:

displaying to a player, using a processor, a potential award and an indicator having a plurality of indicator states when active during play of a game, the potential award being displayed separately from the indicator;

changing, using a processor, the indicator state among the plurality of indicator states in response to play of the game, wherein only one of the indicator states is an award state that is indicative of an award winning outcome, and wherein the other indicator states are indicative of non-winning outcomes;

changing, using a processor, the potential award in response to play of the game, wherein the potential award is selected from a plurality of displayed potential awards which move into and out of a current potential award display position; and awarding the potential award which is displayed only when the indicator state is in the award state.

* * * * *